US009487004B2

(12) United States Patent
Ishimatsu et al.

(10) Patent No.: US 9,487,004 B2
(45) Date of Patent: Nov. 8, 2016

(54) LIQUID DISCHARGE HEAD

(71) Applicant: CANON KABUSHIKI KAISHA, Tokyo (JP)

(72) Inventors: Shin Ishimatsu, Yokohama (JP); Tomohisa Atsuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 14/307,103

(22) Filed: Jun. 17, 2014

(65) Prior Publication Data

US 2014/0368580 A1 Dec. 18, 2014

(30) Foreign Application Priority Data

Jun. 18, 2013 (JP) ..... 2013-127876

(51) Int. Cl.
*B41J 2/165* (2006.01)
*B41J 2/14* (2006.01)

(52) U.S. Cl.
CPC ..... *B41J 2/14* (2013.01); *B41J 2/14072* (2013.01)

(58) Field of Classification Search
None
See application file for complete search history.

(56) References Cited

U.S. PATENT DOCUMENTS

| | | | | |
|---|---|---|---|---|
| 6,267,472 | B1 | 7/2001 | Maher | |
| 7,722,917 | B2 * | 5/2010 | Shimomura et al. | 427/58 |
| 2009/0309915 | A1 | 12/2009 | Noguchi | |
| 2010/0156993 | A1 | 6/2010 | Fukui | |
| 2012/0176451 | A1 | 7/2012 | Iinuma | |
| 2012/0229554 | A1 | 9/2012 | Goto | |
| 2013/0010034 | A1 * | 1/2013 | Nagata | B41J 2/14072 347/58 |
| 2013/0100210 | A1 * | 4/2013 | Harada et al. | 347/50 |
| 2013/0201249 | A1 * | 8/2013 | Hamada et al. | 347/20 |

FOREIGN PATENT DOCUMENTS

| | | | |
|---|---|---|---|
| CN | 101073944 | A | 11/2007 |
| CN | 101607475 | A | 12/2009 |
| CN | 101670708 | A | 3/2010 |
| CN | 101920597 | A | 12/2010 |
| CN | 102458862 | A | 5/2012 |
| JP | 2002-019120 | A | 1/2002 |
| JP | 2005-132102 | A | 5/2005 |
| JP | 2008-062463 | A | 3/2008 |
| WO | 2010/143565 | A1 | 12/2010 |

* cited by examiner

*Primary Examiner* — Alejandro Valencia
(74) *Attorney, Agent, or Firm* — Canon U.S.A., Inc. IP Division

(57) ABSTRACT

A liquid discharge head includes a substrate having discharge energy generating elements generating energy for discharging liquid, a flow path member formed over the substrate and forming a flow path for supplying the liquid, an electric wiring member transmitting a signal for driving the discharge energy generating elements, and an electric connection electrically connecting the substrate to the electric wiring member. The liquid discharge head has a first sealant for sealing under the electric connection, a third sealant for sealing over the electric connection, and a second sealant for sealing side faces where the electric connection is not present, the side faces each being one of side faces of the substrate. An elastic modulus of the third sealant is the largest, that of the first sealant is the second, and that of the second sealant is the smallest. The first and third sealants contain the same type of resin.

8 Claims, 6 Drawing Sheets

FIG. 6

LIST OF SEALANTS USED

| SEALANT APPLICATION/ FORMATION AREA | SEALANT | MAIN COMPONENT | CURING AGENT | FILLER CONTENT | THIXOTROPIC AGENT |
|---|---|---|---|---|---|
| BLOCKING STRUCTURE | OVER-LEAD SEALANT | BISPHENOL A-TYPE EPOXY RESIN | ACID ANHYDRIDE BASED | 73% | CONTAINED |
| UNDER-LEAD SEALING PORTION | UNDER-LEAD SEALANT | BISPHENOL A-TYPE EPOXY RESIN | ACID ANHYDRIDE BASED | 60% | NONE |
| HEAD SUBSTRATE-SIDE SEALING PORTION | PERIMETER SEALANT | SILICONE, POLYBUTADIENE-MODIFIED EPOXY RESIN | AMINE BASED | 0% | NONE |
| OVER-LEAD SEALING PORTION | OVER-LEAD SEALANT | BISPHENOL A-TYPE EPOXY RESIN | ACID ANHYDRIDE BASED | 73% | CONTAINED |

LIST OF SEALANT PROPERTIES

| SEALANT APPLICATION/ FORMATION AREA | SEALANT | WHEN APPLIED (BEFORE CURING) | | AFTER CURING |
|---|---|---|---|---|
| | | THIXOTROPY | VISCOSITY [Pa·s] | ELASTIC MODULUS[MPa] |
| BLOCKING STRUCTURE | OVER-LEAD SEALANT | 3±0.5 | 250±70 | 10000±3000 |
| UNDER-LEAD SEALING PORTION | UNDER-LEAD SEALANT | 1.1±0.3 | 22±6 | 5000±2000 |
| HEAD SUBSTRATE-SIDE SEALING PORTION | PERIMETER SEALANT | 1.0±0.3 | 20±3 | 0.3±0.12 |
| OVER-LEAD SEALING PORTION | OVER-LEAD SEALANT | 3±0.5 | 250±70 | 10000±3000 |

LIQUID DISCHARGE HEAD

BACKGROUND OF THE INVENTION

Field of the Invention

The present invention relates to a liquid discharge head that discharges liquid, such as ink.

Description of the Related Art

A recording method using a liquid discharge head, such as an inkjet recording head, involves supplying thermal and vibration energy to liquid, such as ink, and discharging the ink in the form of micro-droplets through discharge ports to form an image on a recording medium. A method for manufacturing such an inkjet head is disclosed in Japanese Patent Laid-Open No. 2002-019120.

In the manufacture of a liquid discharge head of this type, first, discharge energy generating elements and wiring conductors for supplying power to the discharge energy generating elements are mounted on a silicon substrate. Then, after a protective film is provided over the wiring conductors, an ink flow path and ink discharge ports are patterned with a resist. Next, a through hole (ink supply port) for supplying ink from the back side of the silicon substrate to the discharge energy generating elements is formed in the silicon substrate.

The resultant recording element substrate is attached to a support plate made of alumina or the like, so that the recording element substrate is electrically joined to an electric wiring member.

Next, a perimeter sealant is applied to protect side faces of the recording element substrate from ink and dust. After the perimeter sealant is cured, an inner lead bonding (ILB) sealant (electric-connection sealant) for sealing electric connections is applied over the perimeter sealant.

Functions required of the two sealants used here, the perimeter sealant for sealing around the perimeter of the recording element substrate and the electric-connection sealant, are as follows.

The perimeter sealant is required to quickly flow through a gap with a width of nearly 1 mm between a part on the support plate and the recording element substrate, and to fill the gap in a short time. Additionally, the perimeter sealant is required to protect the recording element substrate from ink and other things.

The electric-connection sealant is required not only to seal electric connections, but also to be resistant to rubbing with a blade or wiper for cleaning the area of ink discharge ports and to contact with paper caused by a paper jam.

A method for applying the two types of sealants, the perimeter sealant and the electric-connection sealant, is disclosed in Japanese Patent Laid-Open No. 2005-132102. This document describes a method in which a hardness of the electric-connection sealant after curing is higher than that of the perimeter sealant after curing and a main component and a curing agent of the electric-connection sealant are the same as those of the perimeter sealant.

With this method, even when the perimeter sealant and the electric-connection sealant are cured at the same time, it is possible to avoid competition for the curing agent (curing inhibition) between the sealants caused by a difference in curing speed.

In recent years, there has been a demand for inexpensive liquid discharge heads capable of printing high-resolution images at high speeds. An effective way for a liquid discharge head to record high-resolution images is to increase the integration density of discharge energy generating elements to a high level. Using inks with high color developing properties is also effective. An effective way to achieve high-speed printing is to increase the number of energy generating elements and increase the length of the liquid discharge head.

FIG. 3A is a diagram of a long and high-density inkjet recording head, as viewed from a direction in which ink is discharged. FIG. 3B is a cross-sectional view taken along line IIIB-IIIB in FIG. 3A. A recording element substrate 1 is provided with two ink supply ports 16 and four rows of discharge ports. The two ink supply ports 16 are filled with the same type of ink, which is then discharged therefrom.

In this inkjet recording head, the two ink supply ports 16 extending in the longitudinal direction of the recording element substrate 1 are arranged in parallel, and the recording element substrate 1 is long in length. Therefore, side faces of the central part of the recording element substrate 1 in the longitudinal direction are structurally sensitive to stress.

The electric-connection sealant has the function of protecting leads and thus has a high elastic modulus (high hardness). The perimeter sealant has a hardness lower than that of the electric-connection sealant. However, since the perimeter sealant contains the same main component and curing agent as those of the electric-connection sealant, the perimeter sealant has to have a certain degree of hardness. Because the perimeter sealant is in contact with ink, it may absorb the ink and swell depending on the use environment. As a result, stress may be applied to side faces of the central part of the recording element substrate 1.

Such a configuration in which stress is applied to the side faces of the central part of the recording element substrate 1 by swelling of the perimeter sealant has not been seen as a problem. However, when the length and the density of the head are further increased, the resulting stress may deform the recording element substrate 1 and flow path members 17, and may negatively affect the print quality. Flexibility in ink selection may be lost, and high image quality with good color developing properties may not be achieved.

SUMMARY OF THE INVENTION

A liquid discharge head includes a substrate having discharge energy generating elements that generate energy used for discharging liquid; a flow path member configured to form a flow path for supplying the liquid, the flow path member being formed over the substrate; an electric wiring member configured to transmit a signal for driving the discharge energy generating elements; and an electric connection configured to electrically connect the substrate to the electric wiring member. The liquid discharge head has a first sealant for sealing a lower region of the electric connection, a third sealant for sealing an upper region of the electric connection, and a second sealant for sealing side faces where the electric connection is not present, the side faces each being one of a plurality of side faces of the substrate. An elastic modulus of the third sealant is greater than an elastic modulus of the first sealant, and an elastic modulus of the second sealant is smaller than an elastic modulus of the first sealant. The first sealant and the third sealant contain the same type of resin.

Further features of the present invention will become apparent from the following description of exemplary embodiments with reference to the attached drawings.

BRIEF DESCRIPTION OF THE DRAWINGS

FIG. 6 is a table showing properties of sealants used in the embodiments.

DESCRIPTION OF THE EMBODIMENTS

First Embodiment

Figure 2:
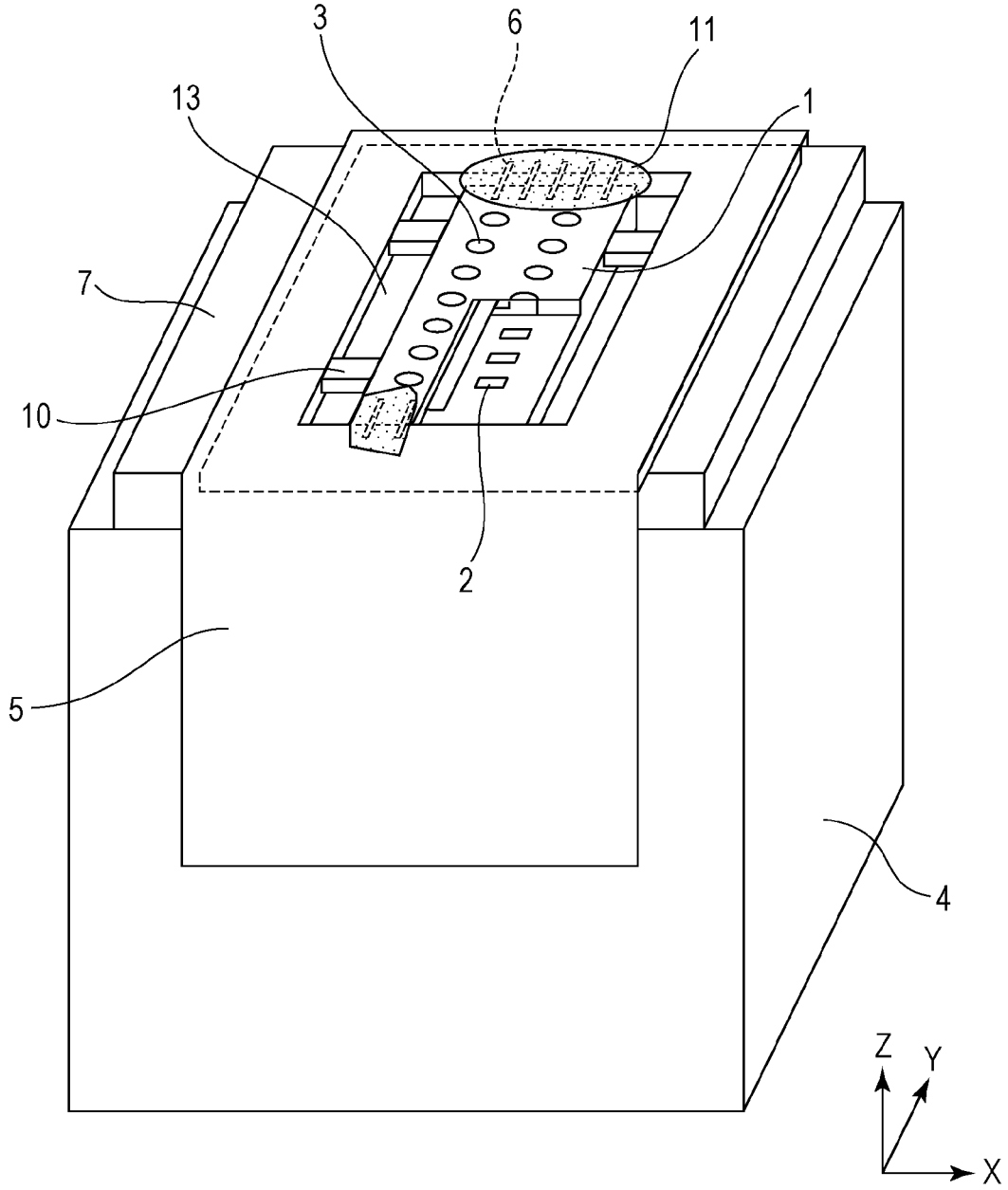
FIG. 2 is a schematic perspective view illustrating a structure of a liquid discharge head according to the first embodiment of the present invention.
Figure 3A:
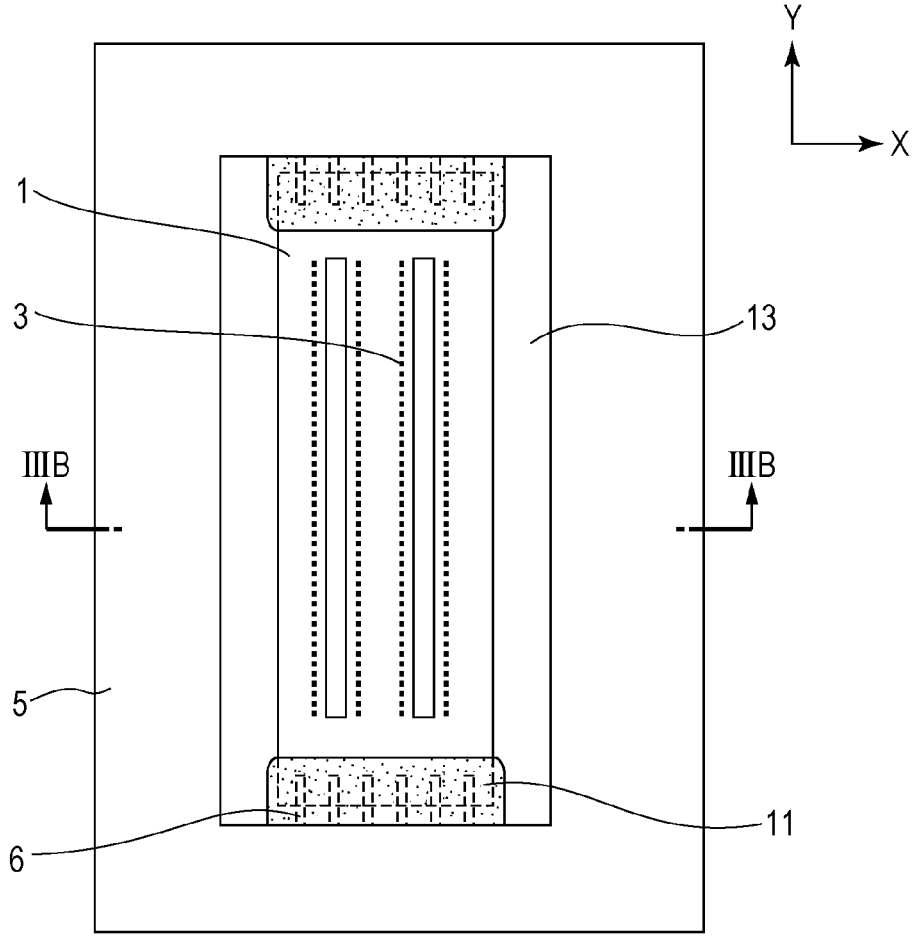
FIGS. 3A and 3B are diagrams illustrating a structure of a liquid discharge head of related art.
Figure 3B:
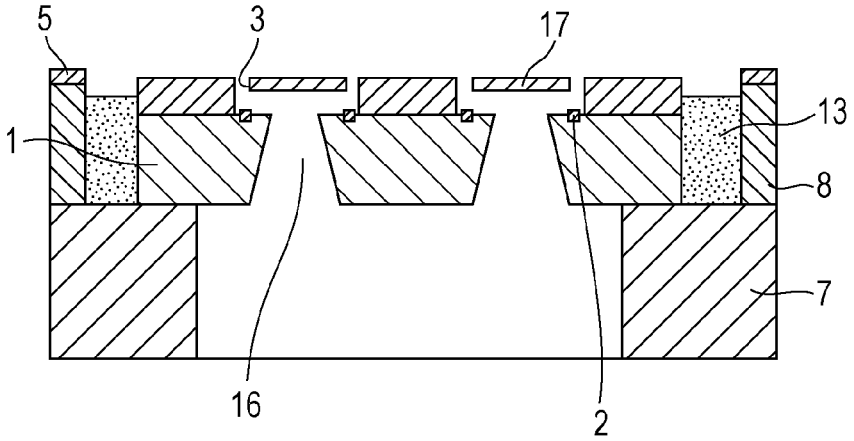

A first embodiment of the present invention will be described with reference to the drawings. FIG. 2 is a schematic perspective view illustrating a structure of a liquid discharge head according to the first embodiment of the present invention. For easy understanding of the structure of a recording element substrate 1, the liquid discharge head is partially cut out in FIG. 2. The recording element substrate 1 includes a silicon substrate having discharge energy generating elements 2 thereon. The discharge energy generating elements 2 are for generating energy to be used for discharging liquid, such as ink. Discharge ports 3 are for discharging ink, and a subtank 4 is for temporarily storing ink to be discharged. An electric wiring member 5 is connected via leads (electric connections) 6 to terminal areas of the recording element substrate 1, to which the electric wiring member 5 transmits an electric signal for driving the discharge energy generating elements 2. A support member 7 supports the recording element substrate 1. A plate 8 (see FIG. 3B) supports the electric wiring member 5. Blocking portions 10 each separate an under-lead sealant and a perimeter sealant (described below). An over-lead sealant (third sealant) 11 is for protecting an upper region of the leads 6. As illustrated in FIG. 3B, the recording element substrate 1 is composed of the silicon substrate (described above) having the discharge energy generating elements 2 thereon, and flow path members 17 above the silicon substrate. The flow path members 17 form flow paths for supplying ink.

Figure 1:
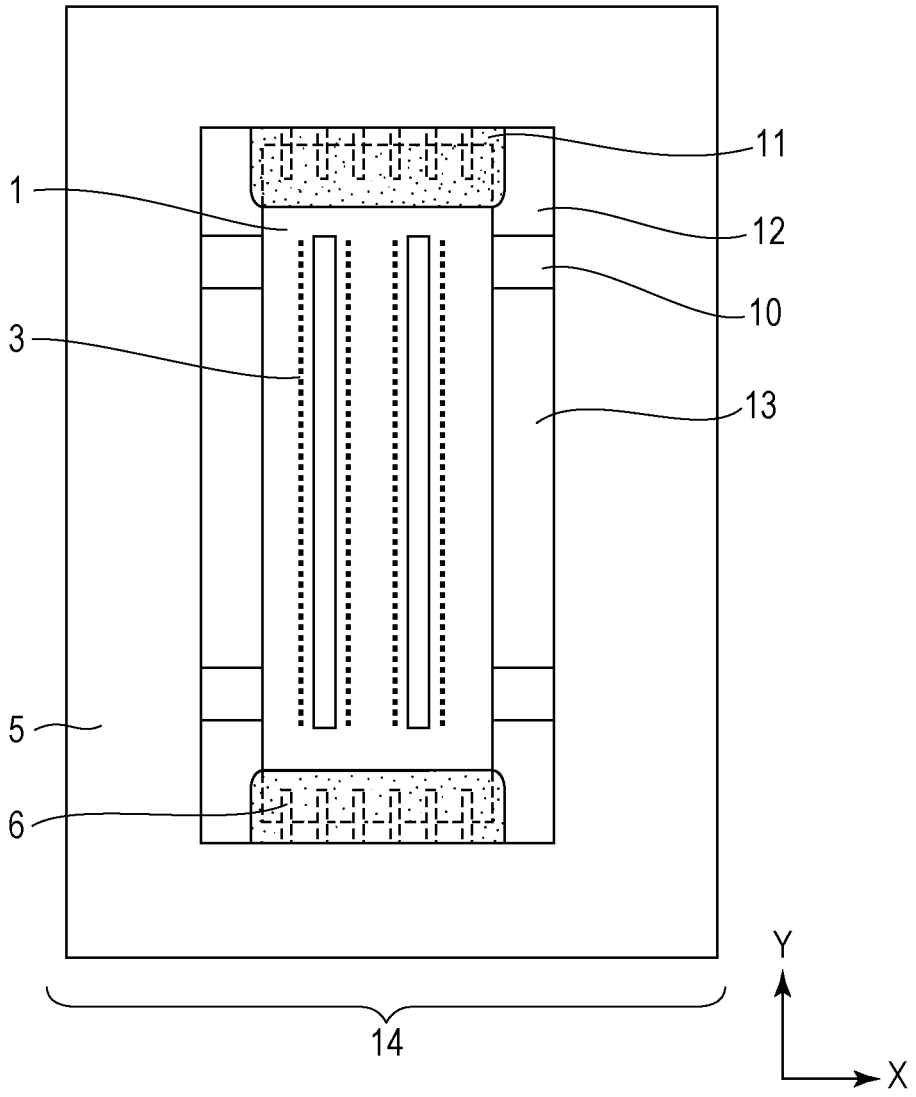
FIG. 1 is a diagram illustrating a recording element unit according to a first embodiment of the present invention.

FIG. 1 is a diagram illustrating a recording element unit 14 according to the first embodiment of the present invention. An under-lead sealant (first sealant) 12 is provided between the recording element substrate 1 and the plate 8 for sealing a gap in a region where the leads 6 are present. A perimeter sealant (second sealant) 13 is provided between the recording element substrate 1 and the plate 8 for sealing a gap in a region where no lead is present.

The blocking portions 10 each separate the perimeter sealant 13 and the under-lead sealant 12 for sealing a lower region of the leads 6. The recording element unit 14 having the structure described above is joined to the subtank 4 to form the liquid discharge head.

In the first embodiment, the recording element unit 14 is made by a sealant application process illustrated in the diagrams of FIGS. 4A to 4F. The recording element substrate 1 of the present embodiment is 3.6 mm by 32.5 mm in size (X-direction by Y-direction in FIG. 1), and 0.62 mm in thickness. In the space between the recording element substrate 1 and the plate 8, a gap in a region where the leads 6 are present is 0.6 mm. Also in the space between the recording element substrate 1 and the plate 8, a gap in a region where no lead is present is 1.8 mm.

Figures 4A, 4B, 4C, 4D, 4E, 4F:
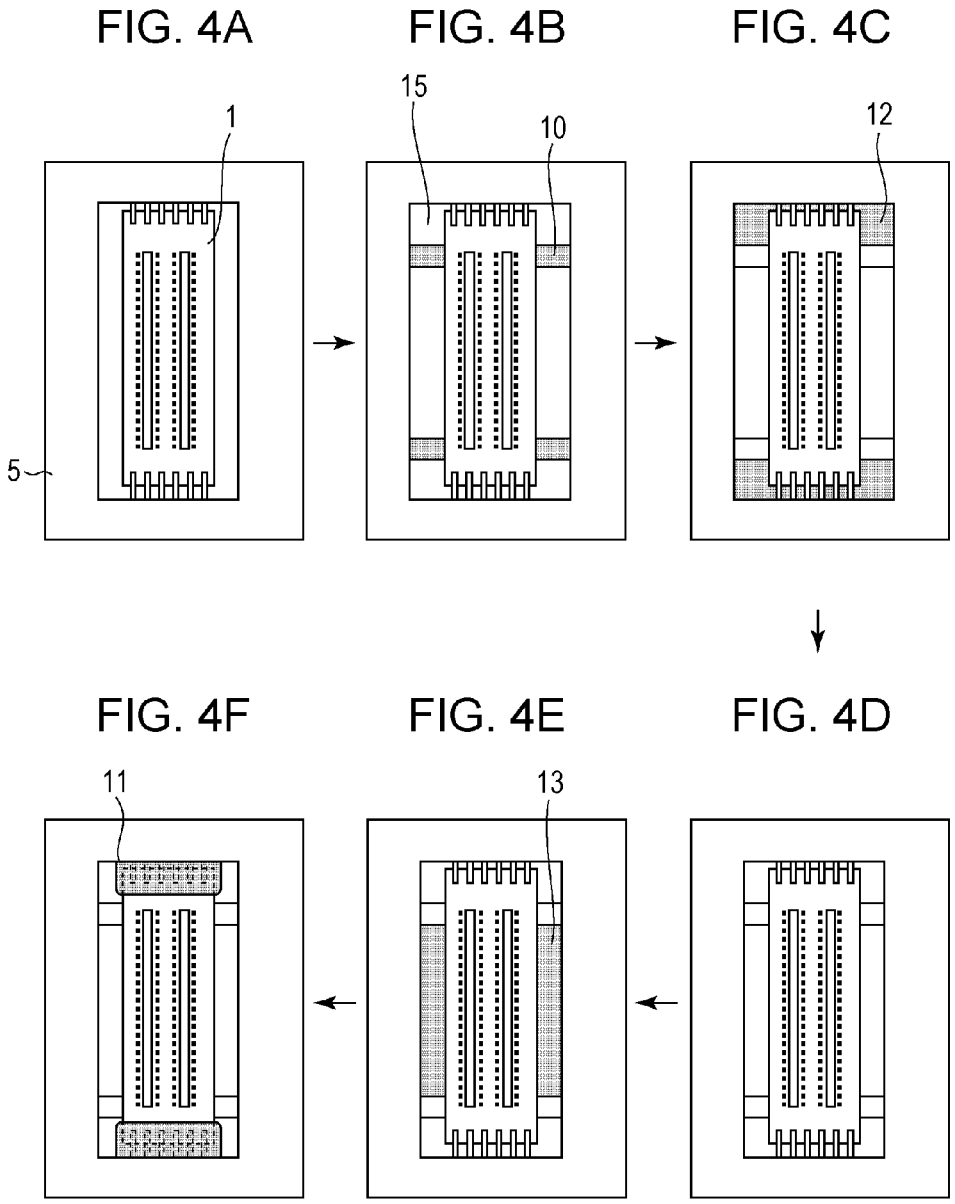
FIGS. 4A to 4F are diagrams illustrating a sealant application process.

FIG. 4A illustrates the recording element unit 14 before application of each sealant thereto. The recording element unit 14 is in a state where, after the recording element substrate 1 and the plate 8 are mounted on the support member 7, the electric wiring member 5 is mounted over the plate 8 to electrically join the electric wiring member 5 to the recording element substrate 1.

Referring to FIG. 4B, the over-lead sealant 11 which is the same as a sealant for sealing an upper part of inner lead bonding (ILB) is applied to part of side faces of the recording element substrate 1 in the longitudinal direction, and semi-cured to form the blocking portions 10. Here, the recording element unit 14 having the over-lead sealant 11 applied thereto is allowed to stand for three minutes on a 150° C. hot plate so as to semi-cure the over-lead sealant 11. A reason for using the over-lead sealant 11 to form the blocking portions 10 is that the over-lead sealant 11 has high thixotropy. To realize the function of the blocking portions 10, it is not necessary to completely cure the over-lead sealant 11. Since the over-lead sealant 11 can be completely cured in a subsequent sealant curing step, it is only necessary at this stage that the over-lead sealant 11 be semi-cured. Thus, the takt time can be shortened. Also, because of the high thixotropy, the flow of the over-lead sealant 11 to other regions can be reduced, and thus the blocking portions 10 can extend to a point near the upper surface of the recording element substrate 1 (in the Z-direction in FIG. 2).

As illustrated in FIG. 4C, the under-lead sealant (first sealant) 12 is applied to under-ILB sealing portions 15. Due to space limitations, the under-lead sealant 12 cannot be directly applied under the leads 6 with a dispenser. Therefore, with the dispenser, the under-lead sealant 12 is applied to regions on both sides of each lead area, and then is allowed to flow under the leads 6. In the present embodiment, after being applied, the under-lead sealant 12 is allowed to stand for three minutes until it flows under the leads 6 and reaches the state of FIG. 4D. To reduce curing inhibition, the composition of the main component and the curing agent of the under-lead sealant 12 is made the same as that of the over-lead sealant (third sealant) 11 to be applied later. To ensure flow properties of the under-lead sealant 12, the amount of filler contained in the under-lead sealant 12 is made smaller than that in the over-lead sealant 11. To reduce curing inhibition between sealants, the over-lead sealant 11 and the under-lead sealant 12 may contain the same type of resin. Additionally, the over-lead sealant 11 and the under-lead sealant 12 may contain the same type of curing agent. The molecular weight of the resin in the over-lead sealant 11 may differ from that of the resin in the under-lead sealant 12. In the present embodiment, both the over-lead sealant 11 and the under-lead sealant 12 use bisphenol A-type epoxy resin as a main component.

As illustrated in FIG. 4E, the perimeter sealant (second sealant) 13 is applied to regions where no lead is present, the regions being in a gap around the perimeter of the recording element substrate 1. In the present embodiment, the perimeter sealant 13 is applied to side faces where no lead is present, the side faces each being one of a plurality of side faces of the recording element substrate 1 of rectangular shape and extending in the longitudinal direction. To prevent excessive stress from being applied to the recording element substrate 1 even if the perimeter sealant 13 absorbs ink and swell, a sealant which is relatively soft (small in elastic modulus) even after being cured is used as the perimeter sealant 13. The elastic modulus of the third sealant is the largest, that of the first sealant is the second, and that of the second sealant is the smallest (i.e., second sealant<first sealant<third sealant).

As illustrated in FIG. 4F, the over-lead sealant (third sealant) 11 is applied over the leads 6 (over the under-lead sealant 12). Then, to cure the under-lead sealant 12 and the perimeter sealant 13 together with the blocking portions 10 formed by application of the over-lead sealant 11, the recording element unit 14 is placed in a 150° C. oven and heated for 3.5 hours.

With the configuration of the present embodiment, curing inhibition is reduced in joining force between the under-lead sealant 12 and the over-lead sealant 11. Since the blocking portions 10 are formed by the over-lead sealant 11, a strong joining force between each blocking portion 10 and the under-lead sealant 12 is ensured. As for joining between each blocking portion 10 and the perimeter sealant 13, curing inhibition, such as separation of their joint faces, may occur due to the difference in material composition. However, even if curing inhibition occurs, the corresponding area is distant from the leads 6. Therefore, even if separation occurs and ink enters the area of separation, further entry of the ink can be blocked by good interfacial adhesion between the blocking portion 10 and the under-lead sealant 12.

The blocking portions 10 are relatively high in stiffness, because of the properties of the over-lead sealant 11 used. If stiffness of the sealant used to form the blocking portions 10 is too high, the sealant may absorb ink and swell, and may apply excessive pressure to the recording element substrate 1. However, since the blocking portions 10 are small in size and the recording element substrate 1 is subjected to stress in only small regions of the side faces thereof, the resulting impact on the recording element substrate 1 is limited. The blocking portions 10 are formed near both ends of each side face of the recording element substrate 1 in the longitudinal direction. Therefore, the recording element substrate 1 is structurally more resistant to stress (deformation) at both end portions than in the central part. Thus, even if stress is applied by the blocking portions 10 to the recording element substrate 1, the resulting impact can be reduced.

The recording element unit 14 made as described above is joined to the subtank 4 to form a liquid discharge head. This liquid discharge head was stored for one week at 70° C., with an upper surface of the recording element substrate 1 immersed in ink, on the basis of the assumption that the liquid discharge head would be used under severe conditions. In printing with this liquid discharge head, good print quality was achieved. However, good print quality was not achieved when printing was performed, under the same use conditions as above, with a recording element substrate (see FIGS. 3A and 3B) serving as a comparative example not using the configuration of the present invention.

FIG. 6 shows a list of sealants used in each part in the first embodiment and properties of the sealants. The advantageous effects of the present invention were confirmed in the range of property values of each sealant shown in FIG. 6. As shown in FIG. 6, the over-lead sealant 11 and the under-lead sealant 12 contain the same type of resin (bisphenol A-type epoxy resin). This reduces curing inhibition between the over-lead sealant 11 and the under-lead sealant 12.

Second Embodiment

Figure 5:
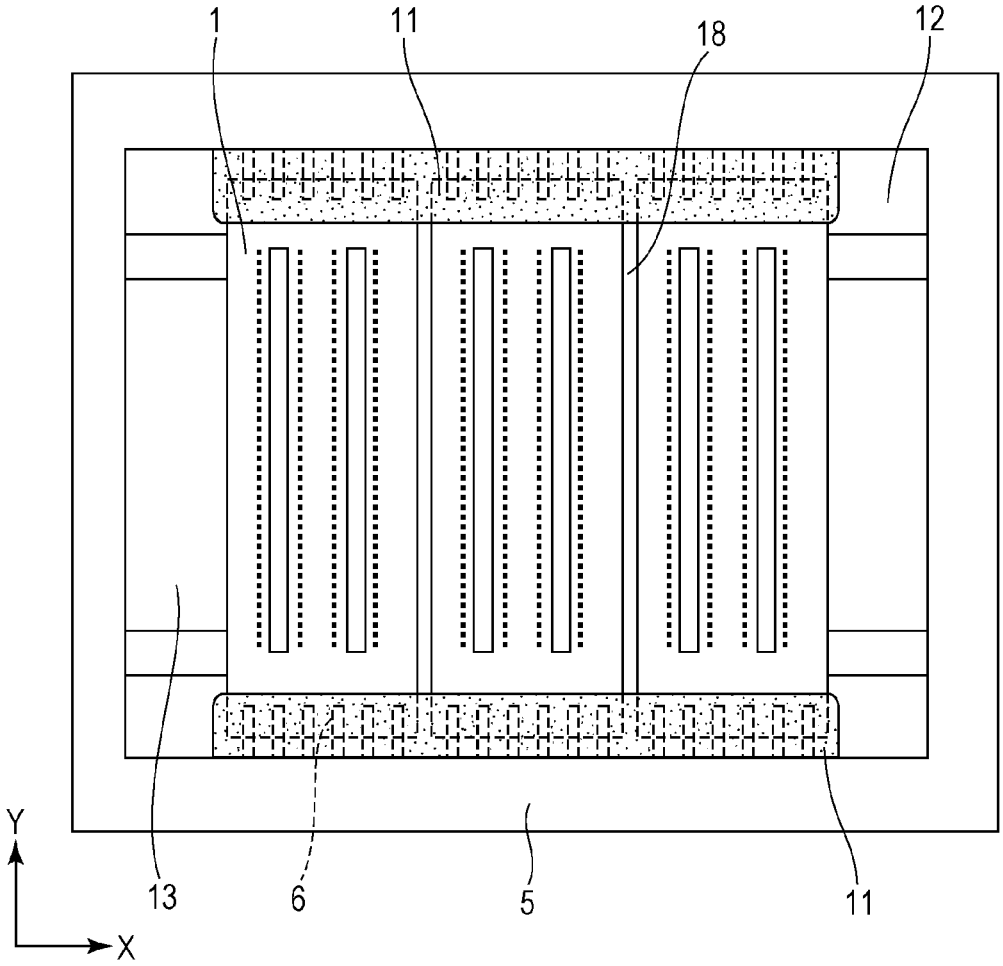
FIG. 5 is a diagram illustrating a recording element unit according to a second embodiment of the present invention.

FIG. 5 is a diagram illustrating a liquid discharge head where multiple recording element substrates 1 are arranged on a support member. Referring to FIG. 5, gaps 18 are created between adjacent recording element substrates 1 parallel to each other. In this liquid discharge head, each sealant can be applied also by the sealant application process illustrated in FIGS. 4A to 4F. The gaps 18 are filled with the under-lead sealant 12 by capillary force. To shorten the takt time in the sealing and filling process of the present embodiment, the recording element substrates 1 are placed in a 40° C. oven and heated for about an hour. This is a temperature at which curing of the under-lead sealant 12 does not start and the viscosity of the sealant can be lowered. The step of heating other sealants is the same as that in the first embodiment.

In the liquid discharge head made as described above, the under-lead sealant 12 in the gaps 18 may swell by absorbing ink depending on the use conditions, and may apply pressure to the central parts of the recording element substrates 1. Because the gaps 18 are minimized in width to reduce the size of the liquid discharge head, the volume of the under-lead sealant 12 applied to the gaps 18 is small and the amount of resulting stress is relatively small. Therefore, it is possible to reduce deformation of the flow path members 17 formed over each recording element substrate 1. In the present embodiment, a liquid discharge head with gaps 18 each being 120 μm in width (i.e., length in the X-direction) was made. Good print quality was achieved when printing was performed with this liquid discharge head under the same use conditions as those in the first embodiment.

The sealants used in the present embodiment, properties of the sealants, and curing conditions are the same as those shown in FIG. 6.

Although no blocking portion is provided in the gaps 18 in the configuration described above, there may be blocking portions 10 in the gaps 18 in the present invention. When each gap 18 is relatively wide, the gap 18 may be provided with blocking portions 10, and the perimeter sealant 13 may be applied between the blocking portions 10.

Although the sealant that forms the blocking portions 10 is the same as the over-lead sealant 11 in the embodiments described above, the present invention is not limited to this. For protection of the leads 6 or accuracy in positioning the blocking portions 10, the type of sealant may be changed as appropriate. The blocking portions 10 may not be formed by sealant, and may be made of resin and formed by injection molding together with the support member 7.

With the configuration described above, it is possible to provide a long, high-density, and highly-reliable liquid discharge head that can reduce curing inhibition between sealants and the impact on flow path members caused by swelling of sealant.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-127876, filed Jun. 18, 2013, which is hereby incorporated by reference herein in its entirety.

What is claimed is:

1. A liquid discharge head comprising:

a substrate having discharge energy generating elements that generate energy used for discharging liquid;

a flow path member configured to form a flow path for supplying the liquid, the flow path member being formed over the substrate;

an electric wiring member configured to transmit a signal for driving the discharge energy generating elements;

an electric connection configured to electrically connect the substrate to the electric wiring member; and a blocking portion provided between a first sealant and a second sealant, to separate the first sealant and the second sealant, wherein the liquid discharge head has the first sealant for sealing a lower region of the electric connection, a third sealant for sealing an upper region of the electric connection, and the second sealant for sealing side faces where the electric connection is not present, the side faces each being one of a plurality of side faces of the substrate;

an elastic modulus of the third sealant is greater than an elastic modulus of the first sealant, and an elastic modulus of the second sealant is smaller than the elastic modulus of the first sealant;

the first sealant and the third sealant contain the same type of resin; and the blocking portion is formed of a sealant of the same type as the third sealant.

2. The liquid discharge head according to claim 1, wherein the first sealant and the third sealant contain the same type of curing agent.

3. The liquid discharge head according to claim 1, wherein both the first sealant and the third sealant contain a filler.

4. The liquid discharge head according to claim 1, wherein the amount of filler contained in the first sealant is smaller than the amount of filler contained in the third sealant.

5. The liquid discharge head according to claim 1, wherein first sealant is lower in thixotropy than the third sealant.

6. The liquid discharge head according to claim 1, further comprising a blocking portion between the first sealant and the second sealant.

7. The liquid discharge head according to claim 6, wherein the blocking portion is formed by a sealant.

8. The liquid discharge head according to claim 7, wherein the blocking portion is formed by the same type of sealant as the third sealant.

* * * * *